US010937618B2

(12) United States Patent
Staffas et al.

(10) Patent No.: US 10,937,618 B2
(45) Date of Patent: Mar. 2, 2021

(54) LATCHING DEVICE AND AN OPERATING MECHANISM WITH SUCH A LATCHING DEVICE

(71) Applicant: ABB Power Grids Switzerland AG, Baden (CH)

(72) Inventors: Daniel Staffas, Ludvika (SE); Johannes Tredoux, Ludvika (SE)

(73) Assignee: ABB Power Grids Switzerland AG, Baden (CH)

( * ) Notice: Subject to any disclaimer, the term of this patent is extended or adjusted under 35 U.S.C. 154(b) by 82 days.

(21) Appl. No.: 16/338,301

(22) PCT Filed: Sep. 26, 2017

(86) PCT No.: PCT/EP2017/074392
§ 371 (c)(1),
(2) Date: Mar. 29, 2019

(87) PCT Pub. No.: WO2018/077556
PCT Pub. Date: May 3, 2018

(65) Prior Publication Data

US 2020/0043689 A1 Feb. 6, 2020

(30) Foreign Application Priority Data

Oct. 25, 2016 (EP) ..... 16195402

(51) Int. Cl.
*H01H 9/20* (2006.01)
*H01H 71/50* (2006.01)
*H01H 3/30* (2006.01)

(52) U.S. Cl.
CPC ..... *H01H 71/505* (2013.01); *H01H 3/3031* (2013.01); *H01H 2071/506* (2013.01)

(58) Field of Classification Search
CPC ..... H01H 71/50; H01H 71/505; H01H 3/30; H01H 3/3031
(Continued)

(56) References Cited

U.S. PATENT DOCUMENTS 1,807,041 A 5/1931 Lingal
2,307,567 A * 1/1943 Coggeshall ..... H01H 3/3015 361/206
(Continued)

FOREIGN PATENT DOCUMENTS

CN 102208290 A 10/2011
EP 2001031 A1 12/2008
(Continued)

OTHER PUBLICATIONS

European Search Report Application No. 16195402.9 Completed: Apr. 25, 2017 6 Pages.
(Continued)

*Primary Examiner* — Shawki S Ismail
*Assistant Examiner* — Lisa N Homza
(74) *Attorney, Agent, or Firm* — Sage Patent Group

(57) ABSTRACT

A latching device for an operating mechanism for an electrical switching apparatus. The device has a locking member movable between a first position and a second position. In the first position the locking member is arranged to lock a drive member of the operating mechanism in a locked position, and a force of the drive member being applied to a contact portion of the locking member. In the second position the locking member is arranged to release the drive member from the locked position. At least in the first position the locking member is arranged to bear against the counter roller. A tripping member is movable between a first position locking the locking member and a second position releasing the locking member. The locking member has a
(Continued)

first portion and a second portion. The first portion is rotatable connected to a first link around a first pivot axis, which first pivot axis is movable perpendicular to its direction. The second portion is rotatable connected to a second link around a second pivot axis and movable perpendicular to its direction. The second link is rotatable connected to the tripping element around a third pivot axis. Movement of the tripping member from its first position to its second position initiates movement of the contact portion out of force-transmitting relation with the drive member.

20 Claims, 1 Drawing Sheet

(58) Field of Classification Search
USPC ..... 335/167
See application file for complete search history.

(56) References Cited

U.S. PATENT DOCUMENTS 2,372,140 A 3/1945 Van Sickle
2,562,147 A * 7/1951 Kuwayama ..... H01H 3/3031 200/82 B
2,601,417 A * 6/1952 William, Jr. ..... H01H 77/101 335/22
2,601,422 A * 6/1952 Thumim ..... H01H 71/2418 335/16
3,152,286 A * 10/1964 Field ..... H01H 75/04 361/67
3,158,714 A * 11/1964 Craig ..... H01H 3/30 335/165
3,198,906 A * 8/1965 Frink ..... H02B 11/133 335/25
3,525,058 A * 8/1970 Astleford, Jr. ..... H01H 73/50 335/35
3,684,848 A * 8/1972 Davies ..... H01H 3/46 200/400
3,810,051 A 5/1974 Walker et al.
4,085,393 A * 4/1978 Grenier ..... H01H 71/2472 335/202
4,087,772 A * 5/1978 Grenier ..... H01H 71/0214 200/303
4,114,123 A * 9/1978 Grenier ..... H01H 71/7463 335/176
4,679,018 A 7/1987 McKee et al.
4,736,174 A * 4/1988 Castonguay ..... H01H 71/522 335/167
4,743,876 A * 5/1988 Milianowicz ..... H01H 83/12 335/173
4,791,250 A * 12/1988 Yin ..... H01H 3/30 200/17 R
5,140,117 A * 8/1992 Vianson ..... H01H 3/30 200/400
5,223,681 A * 6/1993 Buehler ..... H01H 71/504 218/22
5,224,590 A * 7/1993 Milianowicz ..... H01H 3/30 200/400
5,286,936 A * 2/1994 Hatekeyama ..... H01H 3/30 200/400
5,416,291 A * 5/1995 Venzke ..... H01H 71/525 200/17 R
5,418,343 A * 5/1995 Faber ..... H01H 71/16 200/400
5,424,701 A * 6/1995 Castonguay ..... H01H 3/30 200/400
5,713,459 A 2/1998 Beck et al.
5,957,816 A * 9/1999 Staffa ..... A63B 21/154 482/126
6,008,459 A 12/1999 Faber et al.
8,058,580 B2 * 11/2011 Gottschalk ..... H01H 3/3015 200/400
8,519,290 B2 * 8/2013 Ricciuti ..... F16H 53/025 200/574
8,912,870 B2 * 12/2014 Marushima ..... H01H 3/3031 335/190
9,455,098 B2 * 9/2016 Lunden ..... H01H 3/46
2008/0088396 A1 * 4/2008 Ahn ..... H01H 3/30 335/165
2009/0050605 A1 * 2/2009 Ahn ..... H01H 77/101 218/154
2010/0164659 A1 * 7/2010 Ohtsuka ..... H01H 3/30 335/174
2013/0285771 A1 10/2013 Staffas et al.

FOREIGN PATENT DOCUMENTS

EP 2246869 A1 11/2010
GB 426200 A 3/1935
GB 1405747 A 9/1975
WO 2012089550 A1 7/2012

OTHER PUBLICATIONS

International Search Report & Written Opinion of the International Searching Authority Application No. PCT/EP2017/074392 Completed: Nov. 20, 2017; dated Dec. 5, 2017 12 Pages.
Japanese Office Action and Translation Application No. 2019 521070 dated Dec. 17, 2019 4 pages.
Chinese Office Action, Search Report and Translation Application No. 2017800640832 Completed: Aug. 27, 2019 8 Pages.
Indian Patent Application No. 201947015823, Examination Report dated Jun. 30, 2020, 5 pages.

* cited by examiner

LATCHING DEVICE AND AN OPERATING MECHANISM WITH SUCH A LATCHING DEVICE

TECHNICAL FIELD

The present invention relates to a latching device for an operating mechanism for an electrical switching apparatus, the operating mechanism being operatively connectable to the switching apparatus, the latching device comprising a locking member movable between at least one first position and at least one second position, in the first position the locking member being arranged to lock a drive member of the operating mechanism in a locked position and a force of the drive member being applied to a contact portion of the locking member, and in the second position the locking member is arranged to release the drive member from the locked position, a counter roller defining a first axis, at least in the first position the locking member being arranged to bear against the counter roller, a tripping member movable between at least one first trip position and at least one second trip position, in the first trip position the tripping member being arranged to lock the locking member in the first position, and in the second trip position the tripping member is arranged to release the locking member from the locked position. In a second aspect the invention relates to an operating mechanism for an electric switching apparatus.

BACKGROUND

In a power transmission or distribution network, electrical switching apparatuses are incorporated into the network to provide automatic protection in response to abnormal load conditions or to permit opening or closing (switching) of sections of the network. The switching apparatus may therefore be called upon to perform a number of different operations such as interruption of terminal faults or short line faults, interruption of small inductive currents, interruption of capacitive currents, out-of-phase switching or no-load switching, all of which operations are well known to a person skilled in the art.

In switching apparatuses the actual opening or closing operation is carried out by at least two contacts, which are movable in relation to one another, where normally one is stationary and the other is mobile. The mobile contact is operated by an operating system which may comprise a latching device, e.g., controlled by an actuator, and a mechanical system, where the mechanical system operatively connects the latching apparatus to the mobile contact of the switching apparatus.

EP 2 001 031-A1 discloses a latch assembly for an electrical switching apparatus operating mechanism.

US 2009/0050605-A1 describes a circuit breaker having an automatic release linkage.

U.S. Pat. No. 6,008,459 discloses a molded plastic current limiting circuit breaker including an operating mechanism and an actuator.

U.S. Pat. No. 5,713,459 describes a roller latching and release mechanism for electrical switching apparatus.

U.S. Pat. No. 4,679,018 discloses a latch mechanism for a circuit breaker. The latch comprises a linkage with three interconnected link members. The movement of the linkage is activated by an electromagnetic plunger but driven by a spring.

U.S. Pat. No. 3,810,051 discloses a circuit breaker trip and latch mechanism.

U.S. Pat. No. 2,372,140 discloses a latch mechanism for a circuit breaker. The latch comprises a linkage with five interconnected link members. The movement of the linkage is activated by an electromagnet plunger but driven by a spring.

U.S. Pat. No. 1,807,041 discloses a latch mechanism for a circuit breaker. The latch comprises a linkage with three link members driven by an electromagnetic plunger. The mechanism is biased into a locked position by a spring. The resulting movement of the blocking body is sideways and downwards.

The devices in the old US disclosures are generally clumsy and over-dimensioned due to the fact that most of the force that has to be released is transmitted through the mechanism.

EP 2 246 869-A1 discloses a mechanical latching unit for a main drive unit for an electrical switching apparatus with a counter roller such that only a small fraction of the force has to be transmitted through the mechanism. The latching unit comprises a first roller movable between a first position and a second position, in the first position the first roller being adapted to lock a drive tooth of the main drive unit in a locked position and a force of the drive tooth being applied to the first roller. In the second position the first roller is adapted to release the drive tooth from the locked position. The latching unit also comprises a counter roller, and in at least the first position the first roller is adapted to bear against the counter roller. The latching unit further comprises guiding grooves, a carriage and a locking lever for guiding the movement of the first roller. In the first position the first roller is adapted to distribute the force of the drive tooth, applied to the first roller, to a primary force component applied to the counter roller and a secondary force component applied to the carriage.

WO 2012/089550 discloses a device similar to that of EP 2 246 869 and is further provided with guiding means adapted to guide a first portion of the first member in a first direction toward the counter roller. The guiding represents an improvement in relation to EP 2 246 869.

WO 2012/089550 and EP 2 246 869 represent substantial improvements in relation to traditional technique with regards to reliability, resistance to shock and overload conditions, low scatter and operation time. However, there is still a need for improved operation in these aspects. In these prior art devices, the internal moving parts of the latching device are still obstructing the movement of the main arm after it is unlocked by the electromagnet. These internal moving parts must then be pushed out of the way by the main arm, driven by the main spring. This takes time and therefore it increases the operating time of the system.

SUMMARY

The object of the present invention is to attain an improved latching device, in particular to attain a shorter operating time.

This object is achieved by the present invention in that a latching device of the kind specified in the preamble of claim 1 includes the specific features specified in the characterizing portion of the claim. Thus, the locking member has a first portion and a second portion, which first portion is rotatable connected to a first link around a first pivot axis, which first pivot axis is movable perpendicular to its direction, and which second portion is rotatable connected to a second link around a second pivot axis, parallel to the first pivot axis and movable perpendicular to its direction, which second link is rotatable connected to the tripping member around a third pivot axis parallel to the first pivot axis, whereby movement of the tripping member from its first trip position to its second trip position initiates movement of the contact portion out of force-transmitting relation with the drive member.

With such an arrangement of the latch device, the gear function will be driven by the electromagnet which decreases the operation time significantly, as much as by half. The invented latching device has no loose or unconnected parts so the latching function will be predictable and more stable. Also friction is reduced. Fewer parts are required, which reduces the production costs. The drive member will be completely free to pass when the electromagnet has unlocked the latch. This is important for a fast closing-opening maneuver due to the fact that the drive member otherwise will slow down and even stop briefly against the latch when it has to push the internal moving part out of the way. By the invention it is thus achieved that:

- the electromagnet drives the gear function instead of the force from the drive member,
- all moving parts are connected together,
- only one spring is required to reset function,
- main blocking function is removed during pre-tripped CO operation, low friction, and
- fewer parts are required and larger tolerances are allowed for most parts, thereby decreasing product costs.

According to a preferred embodiment, the links during the movement are arranged to move the contact portion in a direction having a first component in the longitudinal direction of the locking member and a second component perpendicular thereto. The longitudinal direction of the locking member is defined as the direction of a line from the contact point between the locking member and the drive member to the contact point between the locking member and the counter roller.

Moving the contact portion simultaneously in two directions in this way facilitates a rapid and well controlled movement of the contact portion out of the force-transmitting relation such that the locking member no longer obstructs movement of the drive member.

According to a further preferred embodiment, the first link is rotatable around a fourth pivot axis parallel to the first pivot axis.

Since the first link is rotatable in that way, its joint with the locking member may follow a path having a circular line as one component during the movement from the first position to the second position. This represents a simple and secure way of attaining the movement of the contact portion in the two directions.

According to a further preferred embodiment, the position of the fourth pivot axis is fixed.

By forcing the first link to pivot around a fixed pivot axis the above mentioned circular line will represent the moving path of the first pivot axis, i.e., the joint between the locking member and the first link. This facilitates to obtain a well-defined and controlled movement of the contact portion.

According to a further preferred embodiment, the third pivot axis is movable perpendicular to its axis.

The possibility of the joint related to this axis to move is a simple way to allow this part of the locking member to move in such a way that he above mentioned moving pattern of the contact portion is attained.

According to a further preferred embodiment, the tripping member is rotatable around a fifth pivot axis parallel to the first pivot axis.

A rotational movement of the tripping movement is advantageous with regards to control the movement of the joint between the tripping member and the second link, which joint is related to the third pivot axis. This movement thereby includes a rotary component of the connected end of the second link such that the other end of this link pulls the locking member adequately.

According to a further preferred embodiment, the position of the fifth pivot axis is fixed.

A fixed pivot axis for the tripping member secures a reliable functioning of the latching device, in particular with regards pulling the end of the locking member that is remote from the contact portion.

According to a further preferred embodiment, the device further includes a trigging member actuated by an electromagnet, which trigging member is arranged to act on the tripping member to move the tripping member from its first trip position to its second trip position by applying a tripping force on the tripping member.

Using a trigging member actuated by an electromagnet represents a rapid initiation of the latching operation. Due to the construction of the invented latching device the force of the trigging member need to be only a small fraction of the locking force, which can be as small as 1% thereof. Thereby the electromagnet may be accordingly dimensioned, i.e., relatively small.

According to a further preferred embodiment, the tripping member includes a first lever arm to which the second link is connected and a second lever arm, on which the trigging member is arranged to act.

The trigging member thereby acts as a two-armed level which makes it possible to optimize the location and orientation of the components, with which it cooperates.

According to a further preferred embodiment, the first and second lever arms are located at an angle of about 180° from each other in relation to the fifth pivot axis.

In many cases this is the most practical arrangement with regards to the cooperation with neighboring elements.

According to a further preferred embodiment, the lever arms have a ratio in the range of 1.5:1-1:1.5, preferably about 1:1.

This represents a symmetric or almost symmetric configuration of the lever with respect to the forces, which normally is advantageous and practical with regards to the dimensioning of the lever and related components.

According to a further preferred embodiment, the length of the locking member is in the range of 1.3-5 times the length of each of the first and second links, preferably in the range of 1.8-2.5.

In order to attain the desired moving pattern of the contact portion it has been found that this means that the locking member preferably should be about twice as long as each of the links. With a too short locking member the sideway movement of the contact part will be harder to attain, and with a too long locking member the stability may be threatened and the device to bulky. The specified range represents a suitable balance in this respect, in particular the narrower range.

According to a further preferred embodiment, the length of the first link is within the range of 0.7-1.5 times the length of the second link, preferably within the range of 0.9-1.1 times.

In order to obtain the desired movement pattern it is simplified if the two links are about equal in length, but a limited deviation therefrom such as within the specified range is acceptable.

According to a further preferred embodiment, the device further includes spring means counter-acting the triggering force and being arranged to return the locking member from its second position to its first position once the actuation has been completed. Actuation is the operation performed when switching the electric apparatus, e.g., the opening of a breaker.

A spring is an effective way of resetting the device, and due to the construction of the invented latching device resetting may be achieved with a relatively simple spring arrangement.

According to a further preferred embodiment, the spring means is a tension spring.

In the context a tension spring provides the simplest and most reliable alternative.

According to a further preferred embodiment, the spring means acts on the connection between the second link and the tripping member or adjacent thereto.

In this area, the resetting force acts particularly effective.

According to a further preferred embodiment, the locking member is arranged to bear against the counter roller during at least a major part of the movement from its first position to its second position.

Supporting the locking member by the counter roller during the complete movement or at least a major part thereof contributes to attain a movement of the locking member that secures a desired movement pattern of the contact portion.

The object of the invention is according to the second aspect of the invention achieved in that an operating mechanism for an electrical switching apparatus, the operating mechanism being operatively connectable to the switching apparatus, and the operating mechanism comprises a latching device and a drive member movable in relation to the latching device between at least one locked position and at least one released position, whereby the latching device comprises the features of the invented latching device, in particular the features of any of the preferred embodiments thereof.

The invented operating mechanism and the preferred embodiments thereof have advantages similar to those of the invented latching device and the advantageous embodiments thereof, which advantages have been described above.

The above described preferred embodiments of the invention are set out in the dependent claims. It is to be understood that further preferred embodiments may be constituted by any possible combination of features of the described preferred embodiments and by any possible combination of features in these with features described in the description of an example below.

DETAILED DESCRIPTION

Figure 1:
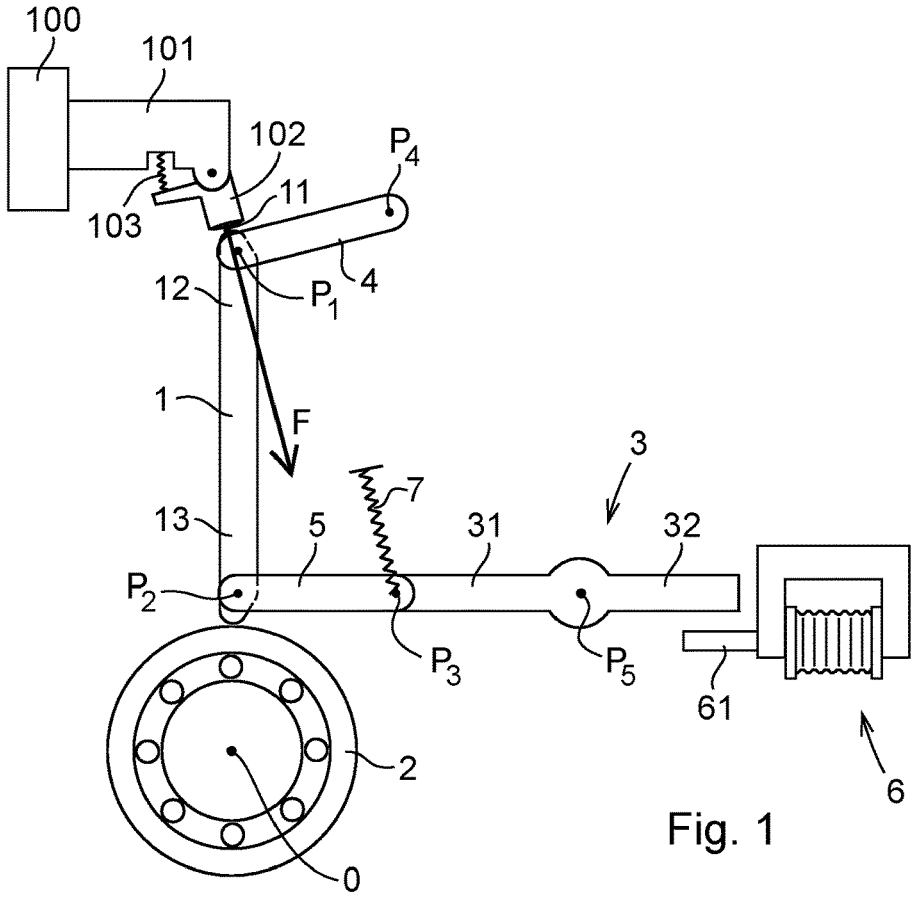
FIG. 1 is a schematic illustration of an example of a latching device according to the invention in a first, locked position.

The latching device is in FIG. 1 illustrated in the position when it keeps the operating mechanism 100 of an electrical switching apparatus, e.g., a breaker in a locked position. In that position the breaker is ready for an opening of the breaker should that be required. The operating mechanism may be of conventional kind and need no explanation to the person skilled in the art. Thus, the operating mechanism is mainly indicated as a box 100 and only the drive member 101 thereof, which cooperates with the invented latching device, is illustrated.

The operating mechanism thus conventionally may have a rotatable drive unit drivingly connected to a rotary drive shaft, which drive shaft is arranged to transmit an actuating movement to the switching apparatus, e.g., to a mobile contact part of the switching apparatus via a mechanical structure known to the skilled person. The mobile contact is movable to and from another contact part to close and open a current path. The operating mechanism may in a conventional manner be provided with biasing means, e.g., a loaded torsion spring, which forces the drive unit thereof and therewith the drive member in a first direction around the drive shaft. In the figure this rotational direction is clockwise.

Figure 2:
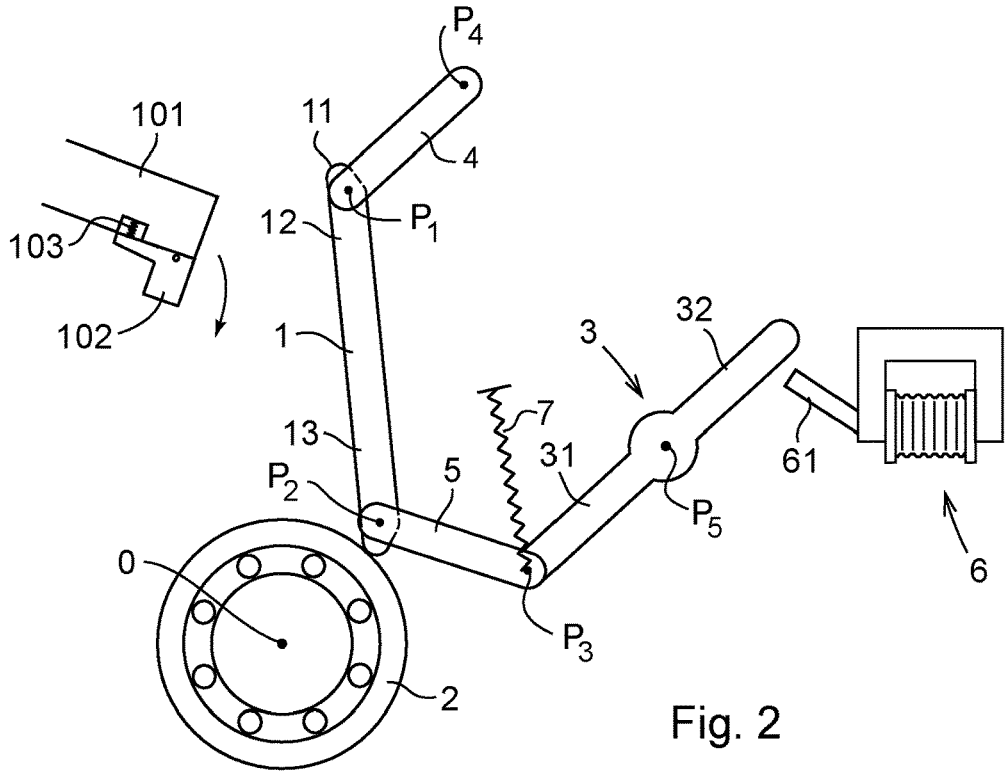
FIG. 2 is a schematic illustration of the latching device of FIG. 1 in a second, released position.

Upon call for a closing operation, the latching device releases the locked drive unit so that it rotates clockwise, whereby the device reaches the position illustrated in FIG. 2. Shortly thereafter the latching device resets the drive unit to its original position in FIG. 1 such that it is ready for another opening operation. This is the general function of a latching device in this context. In the following the particulars of a latching device according to the invention will be described more in detail.

Referring to FIG. 1, the latching device includes a locking member 1, which at its upper end abuts the drive member 101 of the operating mechanism. The drive member 101 is provided with a contact unit 102 pivotally connected thereto. The contact unit 102 is biased by a tension spring 103 in the clockwise direction. The lower end of the locking member 1 abuts a counter roller 2, rotatable around a roller axis O. The drive member 101 exerts a contact force on the locking member 1 due to the rotational biasing thereof mentioned above. The counter roller 2 supports the locking member 1 and thereby takes almost the complete force from the drive member.

The contact force between the drive member 101 and the locking member 1 has a direction that mainly, but not completely aligns with the longitudinal extension of the locking member 1. The direction of the contact force F is illustrated in the figure, however somewhat exaggerated for illustrative purpose. Preferably the angle between the contact force F and the longitudinal direction of the locking member 1, i.e., the direction from the contact point between the locking member 1 and the contact part 102 of the drive member 101 to the contact point between the locking member 1 and the counter roller, should be about 1°. This means that about 99% of the force is taken up by the counter roller 2, whereas about 1% is taken up by the link 5.

At a first portion 12 of the locking member 1, the locking member is pivotally connected to a first end of a first link 4 around a first pivot axis P1. In the illustrated example this connection is located at the upper end of the locking member close to the contact point. The first pivot axis P1 extends perpendicular to the plane of the paper and thus is in parallel to the rotational axis (not shown) of the operating mechanism 100. The first axis P1 is movable perpendicular to the direction thereof. The second end of the first link 4 is pivotable around a fourth pivot axis P4, which is stationary and in parallel to the first pivot axis P1.

A second portion 13 of the first member 1 is pivotally connected to a first end of a second link 5 around a second pivot axis P2, which is in parallel to the first pivot axis P1 and is movable perpendicular to its direction. The second pivot axis P2 is in this example located at the lower end of the locking member 1 close to its contact point with the counter roller 2.

The second link 5 is pivotally connected to a tripping member 3 around a third pivot axis P3. The third pivot axis P3 is in parallel to the first pivot axis P1 and is movable perpendicular to its direction. The tripping member 3 in this example is configured as a lever rotatable around a fifth pivot axis P5 which is stationary and in parallel to the first pivot axis P1. It has two lever arms 31, 32 diametrically arranged in relation to each other. The second link 5 is connected to the end of the first lever arm 31.

A tension spring 7 is connected to the pivotal joint between the second link 5 and the first lever arm 31.

Adjacent the second lever arm 32 an electromagnet 6 is located, which is provided with a plunger 61 arranged to be able to act on the second lever arm 32.

Upon a signal indicating that the breaker need to be opened, the electromagnet 6 is activated which results in a releasing of the drive unit 100 to accomplish opening and the device will reach the position illustrated in FIG. 2.

This occurs in the following way: Activation of the electromagnet 6 affects the plunger 61 to pivot clockwise. Thereby the plunger 61 hits the second level arm 32 such that the tripping member 3 will rotate counter-clockwise. The pivot joint between the second link 5 and the first level arm 31, with the third pivot axis P3 will thus move along a circular line in the counter-clockwise direction. The second picot axis P2, at the joint between locking member 1 and the second link 5 thereby will move clockwise along a circular path adjacent the periphery of the counter roller 2. This is because of the downwardly and increasingly rightwardly directed pulling force from the first lever arm 31 on the second link 5. The first pivot axis P1 where the locking member 1 is connected to the first link 4 thereby also will move downward and leftward along a circular path defined by the first link 4 as it rotates counter-clockwise around the fourth pivot axis P4.

This movement of the first pivot axis P1 moves the contact point 11 of the locking member 1 out of contact with the contact unit 102 of the drive member 101 both in the downward and in the rightward direction. The rightwardly directed component of the movement gives free way for the drive member 101 to move downwards, as illustrated in FIG. 2, and thereby open the breaker by rotating the operating mechanism. The drive member 101 thus does not have to push the locking member 1 as it moves, which otherwise would slow down its speed. Neither will it be affected by any friction from the locking member 1 since it is out of its way. An opening operation with a device according to the claims can be achieved as fast as in 7 milliseconds.

The force necessary for the plunger 61 to act on the level 3 corresponds substantially to the horizontal component of the contact force F. The horizontal component is about 1% of the contact force F, i.e., the locking force. The ratio of the required triggering force to the locking force is thus about 1:100.

During the opening movement the tension spring 7 will be tensioned by the movement of the joint around the third pivot axis P3. When opening is completed the tension spring 7 will pull the device back to its starting position as illustrated in FIG. 1. During resetting of the device, the contact unit 102 of the drive member 101 will be somewhat retracted in the clock-wise direction due to the spring 103. This facilitates for the drive member 101 to pass the locking member 1 when counter-clockwise returning to the FIG. 1 position.

The invention claimed is:

1. A latching device for an operating mechanism for an electrical switching apparatus, the operating mechanism being operatively connectable to the switching apparatus, the latching device comprising:

a locking member movable between at least one first position and at least one second position, in the first position the locking member being arranged to lock a drive member of the operating mechanism in a locked position and a force (F) of the drive member being applied to a contact portion of the locking member, and in the second position the locking member is arranged to release the drive member from the locked position, a counter roller defining a first axis (O), at least in the first position the locking member being arranged to bear against the counter roller, a tripping member movable between at least one first trip position and at least one second trip position, in the first trip position the tripping member being arranged to lock the locking member in the first position, and in the second trip position the tripping member is arranged to release the locking member from the locked position, wherein the locking member has a first portion and a second portion, which first portion is rotatable connected to a first link around a first pivot axis (P1), which first pivot axis (P1) is movable perpendicular to its direction, and which second portion is rotatable connected to a second link around a second pivot axis (P2), parallel to the first pivot axis (P1) and movable perpendicular to its direction, which second link is rotatable connected to the tripping member around a third pivot axis (P3) parallel to the first pivot axis (P1), whereby movement of the tripping member from its first trip position to its second trip position initiates movement of the contact portion out of force-transmitting relation with the drive member.

2. The latching device according to claim 1, wherein said links during said movement are arranged to move the contact portion in a direction having a first component in the longitudinal direction of the locking member and a second component perpendicular thereto.

3. The latching device according to claim 2, wherein the length of the locking member is in the range of 1.3-5 times the length of each of the first and second links, preferably in the range of 1.8-2.5.

4. The latching device according to claim 2, wherein the length of the first link is within the range of 0.7-1.5 times the length of the second link, preferably within the range of 0.9-1.1 times.

5. The latching device according to claim 2, wherein the first link is rotatable around a fourth pivot axis parallel to the first pivot axis (P1).

6. The latching device according to claim 2, wherein the third pivot axis (P3) is movable perpendicular to its axis.

7. The latching device according to claim 1, wherein the first link is rotatable around a fourth pivot axis (P4) parallel to the first pivot axis (P1).

8. The latching device according to claim 7, wherein the position of the fourth pivot axis (P4) is fixed.

9. The latching device according to claim 1, wherein the third pivot axis (P3) is movable perpendicular to its axis.

10. The latching device according to claim 1, wherein the tripping member is rotatable around a fifth pivot axis (P5) parallel to the first pivot axis (P1).

11. The latching device according to claim 10, wherein the position of the fifth pivot axis (P5) is fixed.

12. The latching device according to claim 1, and further including a trigging member actuated by an electro-magnet, which trigging member is arranged to act on the tripping member to move the tripping member from its first trip position to its second trip position by applying a tripping force on the tripping member.

13. The latching device according to claim 12, wherein the tripping member includes a first lever arm to which the second link is connected and a second lever arm, on which the trigging member is arranged to act.

14. The latching device according to claim 1, wherein the length of the locking member is in the range of 1.3-5 times the length of each of the first and second links, preferably in the range of 1.8-2.5.

15. The latching device according to claim 1, wherein the length of the first link is within the range of 0.7-1.5 times the length of the second link, preferably within the range of 0.9-1.1 times.

16. The latching device according to claim 15, wherein the spring means acts on the connection between the second link and the tripping member or adjacent thereto.

17. The latching device according to claim 1, and further including spring means counter-acting the triggering force and being arranged to return the locking member from its second position to its first position once the actuation has been completed.

18. The latching device according to claim 17, wherein the spring means acts on the connection between the second link and the tripping member or adjacent thereto.

19. The latching device according to claim 1, wherein the locking member is arranged to bear against the counter roller during at least a major part of the movement from its first position to its second position.

20. An operating mechanism for an electrical switching apparatus, the operating mechanism being operatively connectable to the switching apparatus, and the operating mechanism comprises a latching device and a drive member movable in relation to the latching device between at least one locked position and at least one released position, wherein the latching device includes the features mentioned in claim 1.

* * * * *